US006597863B2

(12) United States Patent
Koskey, Jr.

(10) Patent No.: US 6,597,863 B2
(45) Date of Patent: Jul. 22, 2003

(54) DEVICE FOR KEEPING A PORTION OF A BODY OF WATER FREE FROM ICE

(76) Inventor: James Donald Koskey, Jr., 210 Mesa Ave., Manitou Springs, CO (US) 80929

( * ) Notice: Subject to any disclaimer, the term of this patent is extended or adjusted under 35 U.S.C. 154(b) by 0 days.

(21) Appl. No.: 09/813,337

(22) Filed: Mar. 20, 2001

(65) Prior Publication Data

US 2002/0136545 A1 Sep. 26, 2002

(51) Int. Cl.[7] ..... H05B 3/80
(52) U.S. Cl. ..... 392/499; 219/523; 219/538

(58) Field of Search ..... 392/499; 219/523, 219/538

(56) References Cited

FOREIGN PATENT DOCUMENTS

GB 2317799 A 4/1998 ..... A01K/61/00

*Primary Examiner*—Thor Campbell
(74) *Attorney, Agent, or Firm*—Law Office of Dale B. Halling, LLC

(57) ABSTRACT

A device for keeping a portion of a body of water free from ice includes a heating element and a buoyant enclosure to contain the heating element.

13 Claims, 2 Drawing Sheets

DEVICE FOR KEEPING A PORTION OF A BODY OF WATER FREE FROM ICE

FIELD OF THE INVENTION

The present invention relates generally to the field of water heaters and more particularly toward a device for keeping a portion of a body of water free from ice.

BACKGROUND OF THE INVENTION

Pond heaters are required in ponds that support living creatures, like fish and plants. Living creatures, through respiration and other processes, release waste gases and products into their environment, i.e., the pond. The process of decomposition releases waste products into the environment as well. Normally, the gases in the water can achieve equilibrium with the air. The gas exchange process occurs at the surface of the water, where the air and water meet. However, when the surface of the water is frozen, no gas exchange can occur. The cessation of gas exchange results in the accumulation of waste gases in the water. When the concentration of waste gases in the water reach a toxic level, the fish and plants will die. For a homeowner who has time and money invested in a pond, this can be an expensive proposition. To combat this problem, pond heaters were developed to keep some part of the water's surface free from ice. Present pond heaters perform their role within their design limitations. However, while these pond heaters are effective, they are also costly to operate and potentially dangerous to use. They are costly because they operate at a typical 1250 to 1500 watts or more. Such heaters are potentially dangerous because the heating element is unshielded and very hot. Inadvertent contact with the heating element will cause severe burns.

Thus there is a need for a heater that allows not only the exchange of gases, but that also provides some insulative properties to allow the heater to operate more efficiently, significantly reducing the power consumption and increasing the safety of the heater.

DETAILED DESCRIPTION OF THE DRAWINGS

A device for keeping a portion of a body of water free from ice includes a heating element and a buoyant enclosure to contain the heating element. The device operates with far greater efficiency and safety than is currently known. The device may operate on about 100 watts, as compared to the 1500 watts required to operate the currently existing models. In addition, the heating element is completely enclosed within the device, and operates with a lower heat output making it much safer to handle. The device permits the gas exchange process to continue to occur, even when temperatures drop below zero degrees Fahrenheit. This is particularly important where body of water is small and susceptible to freezing over, such as with a decorative pond. In such a case, the cessation of the gas exchange process will lead to the accumulation of waste gases and could kill the fish or other living creatures in the body of water.

While this device is described with respect to a pond or other small body of water, the device may be used in other roles, such as in stock watering tanks, or other outdoor water containers. Used in this role, the device will keep a portion of the water free from ice and permit animals to drink from the tank, where the tank may otherwise be frozen over. If used in this manner, the diaphragm or cover over the center of the device may need to be modified or removed to allow the animals access to the water.

Figure 1:
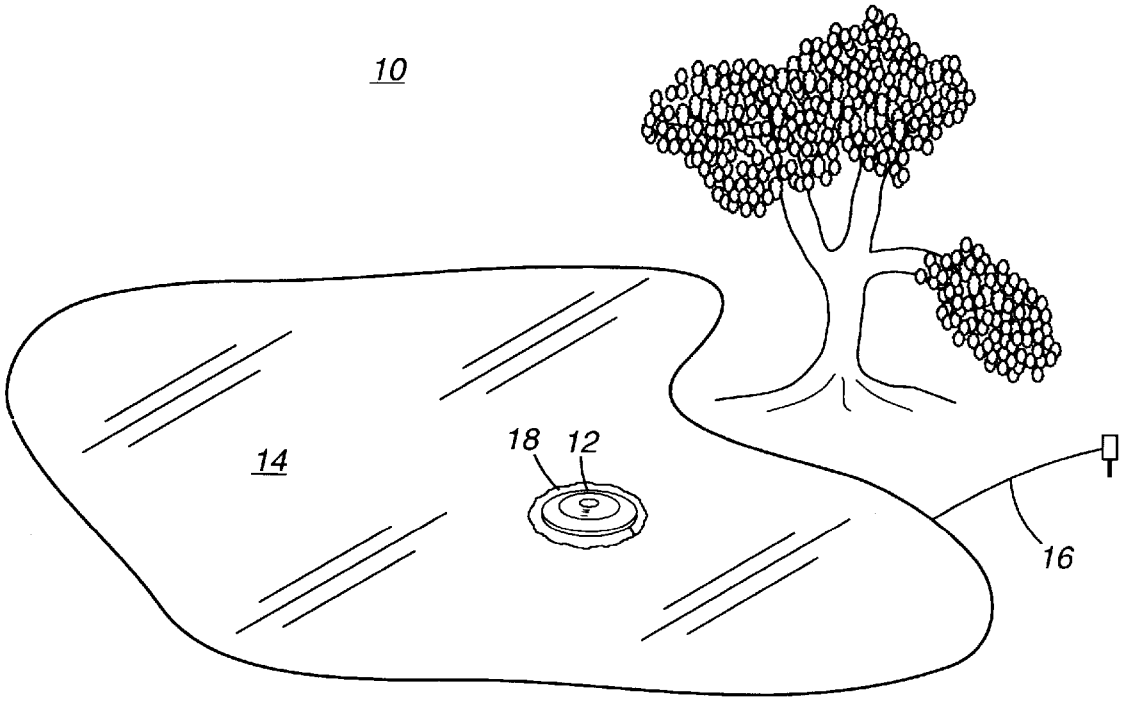
FIG. 1 is a cartoon drawing depicting a device for keeping a portion of a body of water free from ice in accordance with one embodiment of the invention.

FIG. 1 is a cartoon drawing 10 depicting a device 12 for keeping a portion of a body of water 14 free from ice in accordance with one embodiment of the invention. The device 12 is set afloat in the body of water 14 and is then connected to a power supply 16. The device 12 comprises a heating element and a buoyant enclosure to contain the heating element. The buoyant enclosure is waterproof. In one embodiment, the buoyant enclosure is substantially annular shaped. The opening of the substantially annular shaped enclosure includes a diaphragm across an opening. The diaphragm includes a vent. In another embodiment, the heating element is less than 500 watts. While the device 12 is in operation, it will keep an area of the body of water 14 free from ice 18, permitting as exchange to occur.

Figure 2:
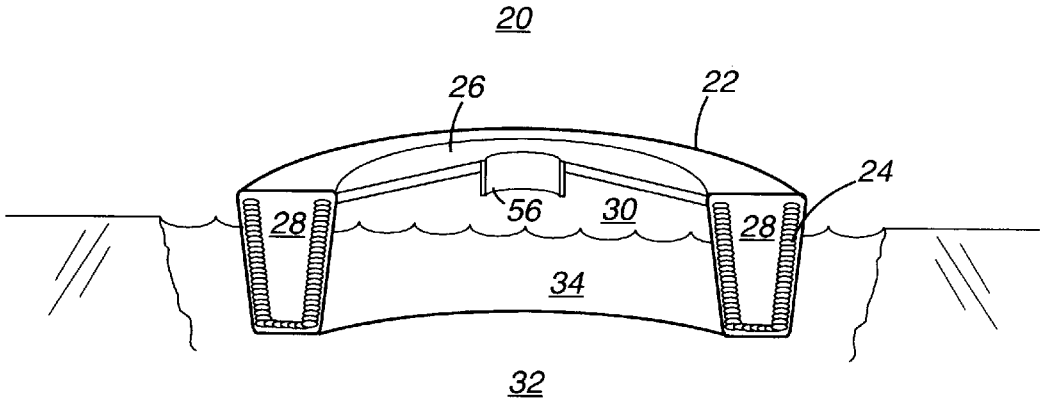
FIG. 2 is a cross-sectional view of a device for keeping a portion of a body of water free from ice in accordance with one embodiment of the invention.

FIG. 2 is a cross-sectional view 20 of a device 22 for keeping a portion of a body of water free from ice in accordance with one embodiment of the invention. The device 22 comprises a heating element 24 and a waterproof housing 26 to contain the heating element 24. The heating element 24 is located in an interior chamber 28 of the waterproof housing 26. The waterproof housing 26 has an interior surface 30 that is in communication with the body of water 32 and defines a volume of water. The waterproof housing 26 has insulative properties and may be substantially torus shaped. These insulative properties come from several features of the device: the torus shape which acts to protect the water within the interior opening 34, and the waterproof housing 26 which contains an insulative dead air space in the interior chamber 28. Other insulating methods and materials should be obvious to one skilled in the art. One of the plurality of heating elements radiates into the interior opening 34. Water within the interior opening 34 of the waterproof housing 26 receives energy from the heating element 24. This energy is focused within the opening and does not simply radiate away in an uncontrolled manner, like prior art devices. The interior opening 34 affords some insulative protection to the interior water. In another embodiment, there may be a plurality of heating elements. The heating elements may be distributed through the chamber 28 in the waterproof housing 26 to heat targeted areas. For example, an exterior heating element may be located in the chamber 28 to radiate to the exterior of the waterproof housing 26. It would act to raise the temperature of the water in contact with the outside of the waterproof housing 26. This would reduce the likelihood of the device becoming frozen into the body of water 32.

Figure 3:
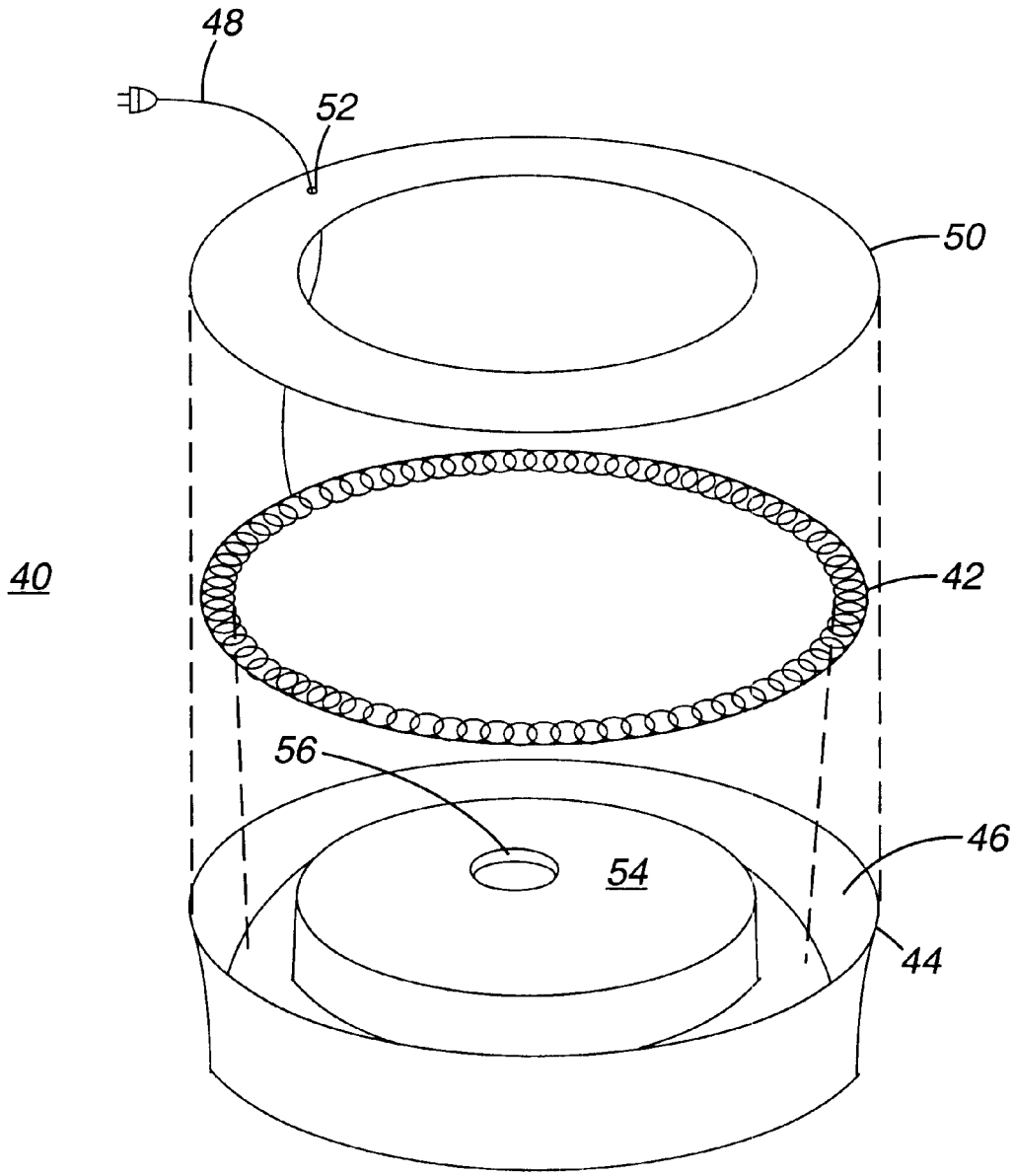
FIG. 3 is an exploded view of a device for keeping a portion of a body of water free from ice in accordance with one embodiment of the invention.

FIG. 3 is an exploded view 40 of a device for keeping a portion of a body of water free from ice in accordance with one embodiment of the invention. The device comprises a heating element 42 and a buoyant enclosure 44 to contain the heating element 42. The heating element is located in a chamber 46 inside the buoyant enclosure 44. Power is supplied to the heating element 42 via a power cord 48. The chamber 46 is sealed with a lid 50, which is affixed to the top of the buoyant enclosure 44. In one embodiment, the power cord 48 passes through the lid 50 of the buoyant enclosure 44 via a waterproof grommet 52. In one embodiment, the buoyant enclosure 44 is a waterproof housing. The buoyant enclosure 44 has an interior surface that defines an interior volume of water and has an opening that provides communication with an exterior volume of water, and a heating element 42 that radiates into the interior volume of water. In another embodiment, the buoyant enclosure 44 is substantially torus shaped. In another embodiment, a plurality of heating elements may be used. One of the plurality of heating elements may be located in the chamber 46 so as to radiate into the exterior volume of water. The buoyant enclosure 44 includes insulative properties. The insulative properties come from the dead air space within the chamber 46 for the heating element 42. In one embodiment the buoyant enclosure 44 includes a cover 54 which traverses an exposed opening of the buoyant enclosure 44. Further insulative properties come from the cover 54. In another embodiment, the cover 54 includes a stovepipe port 56 in the cover 54. The stovepipe vent 56 extends down from the surface of the cover 54, toward the water. The cover 54 protects a portion of the surface of the water from the exterior temperatures and acts to retain accumulated heat, increasing the device's efficiency. The pond owner will realize the greatest energy savings and thermal efficiency where several or all of these features are combined in one device. Such an integrated system will permit the device to operate properly on about 100 watts, with temperatures well below freezing.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A device for keeping a portion of a body of water free from ice comprising:

a heating element;

a buoyant enclosure to contain the heating element having an insulative dead air space;

a diaphragm across an opening of the buoyant enclosure and having a single opening above a water line; and a stovepipe vent extending down from the diaphragm.

2. The system of claim 1, wherein the buoyant enclosure is waterproof.

3. The system of claim 1, wherein the buoyant enclosure is substantially annular shaped.

4. The system of claim 1, wherein the heating element is less than 500 watts.

5. A device for keeping a portion of a body of water free from ice comprising:

a heating element having energy focused into an interior chamber;

a waterproof housing to contain the heating element and having an interior surface that is in communication with the body of water, the waterproof housing forming the interior chamber and having an insulative dead air space;

a cover which traverses an exposed opening of the waterproof housing; and a stovepipe vent extending down from the cover.

6. The system of claim 5, wherein the waterproof housing comprises an interior opening that defines a volume of water.

7. The system of claim 5, wherein the one of the plurality of heating elements radiates to the exterior of the waterproof housing.

8. The system of claim 5, wherein the waterproof housing is substantially torus shaped.

9. The system of claim 6, wherein the waterproof housing has insulative properties.

10. A device for keeping a portion of a body of water free from ice comprising:

a housing having an interior surface that defines an interior volume of water and has an opening that provides communication with an exterior volume of water, the housing having an insulative dead airspace;

a heating element having energy focused into the interior volume of water;

a cover which traverses an exposed opening of the housing; and a stovepipe vent extending down from the cover.

11. The system of claim 10, wherein the housing includes a chamber for the heating element.

12. The system of claim 10, further comprising:

a heating element that radiates into the exterior volume of water.

13. The system of claim 10, wherein the housing includes insulative properties.

* * * * *